United States Patent [19]

Kolibaba et al.

[11] Patent Number: 4,771,410

[45] Date of Patent: Sep. 13, 1988

[54] BUGLE ALARM CLOCK SYSTEM

[76] Inventors: Edward J. Kolibaba; Jane L. Kolibaba, both of 1301 NW. 52nd St., Vancouver, Wash. 98663

[21] Appl. No.: 116,546

[22] Filed: Nov. 4, 1987

[51] Int. Cl.[4] ..... G04B 23/02; G04B 37/00; A47F 7/00

[52] U.S. Cl. ..... 368/73; 368/316; 248/114

[58] Field of Search ..... 368/72–74, 368/250–251, 243–244, 272–274, 316–317; 248/114–116

[56] References Cited

U.S. PATENT DOCUMENTS 390,786 10/1888 Lane ..... 368/244

3,376,700 4/1968 Davis et al. ..... 368/274

*Primary Examiner*—Vit W. Miska

*Attorney, Agent, or Firm*—Marger & Johnson

[57] ABSTRACT

An alarm clock system is provided including a replica of a bugle mounted on a stand in a playing position. The bugle replica includes an alarm clock and an apparatus for generating an audible rendition of the tune "Reveille" when the clock indicates a predetermined time, thereby awakening a user.

18 Claims, 2 Drawing Sheets

FIG. 1
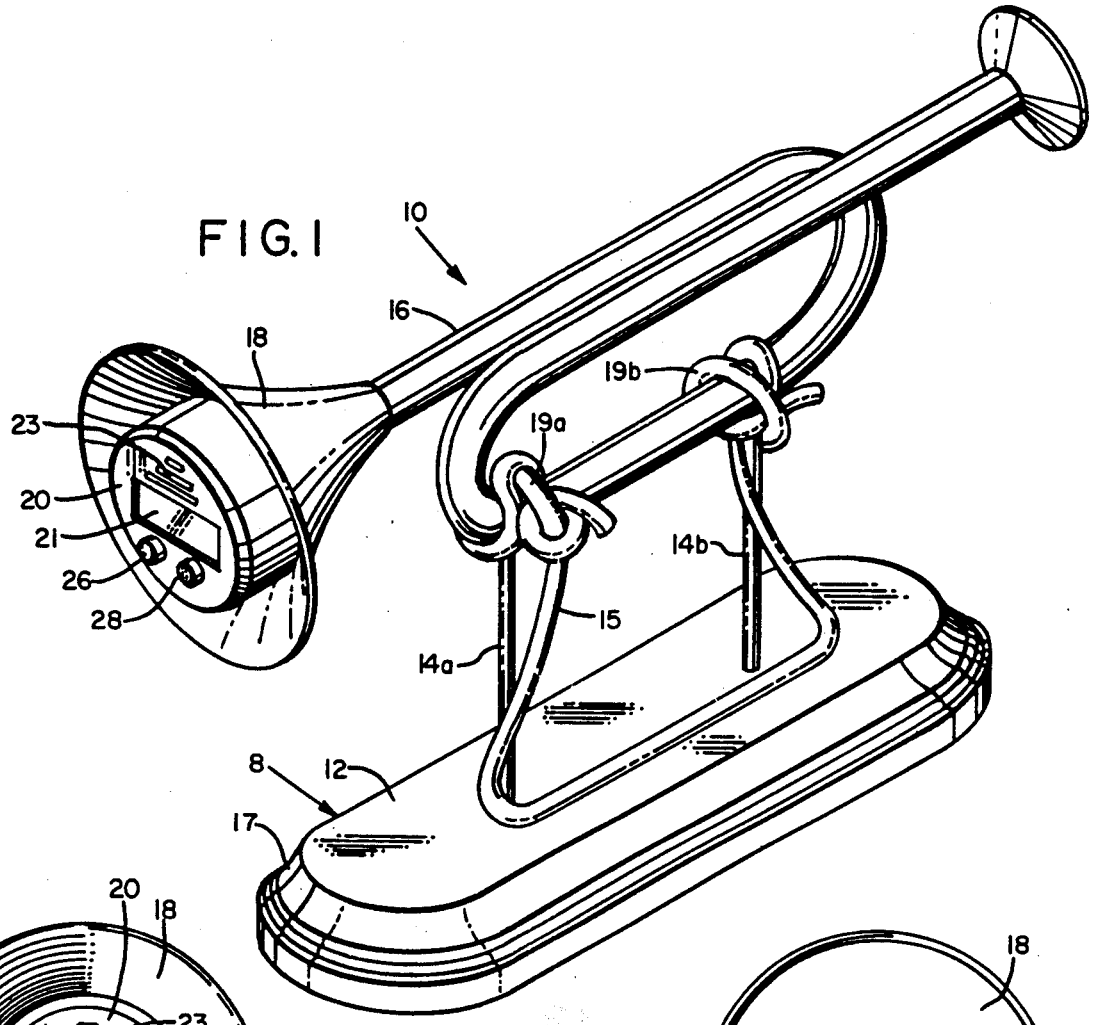
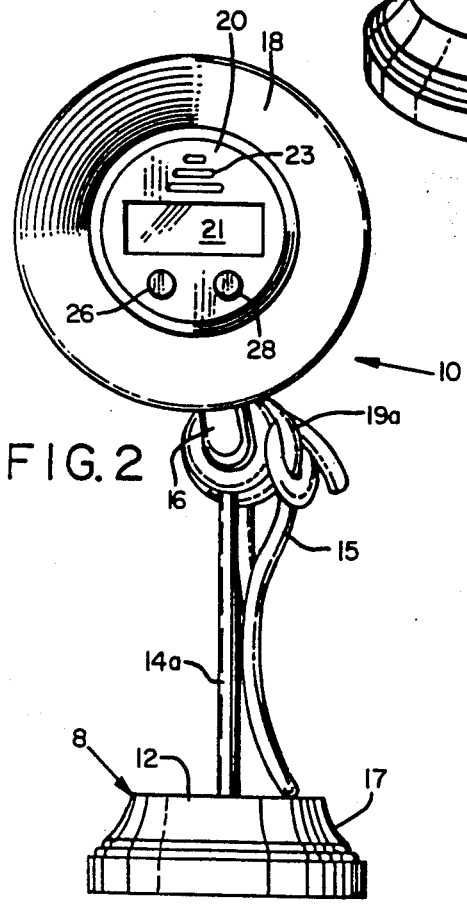
FIG. 2
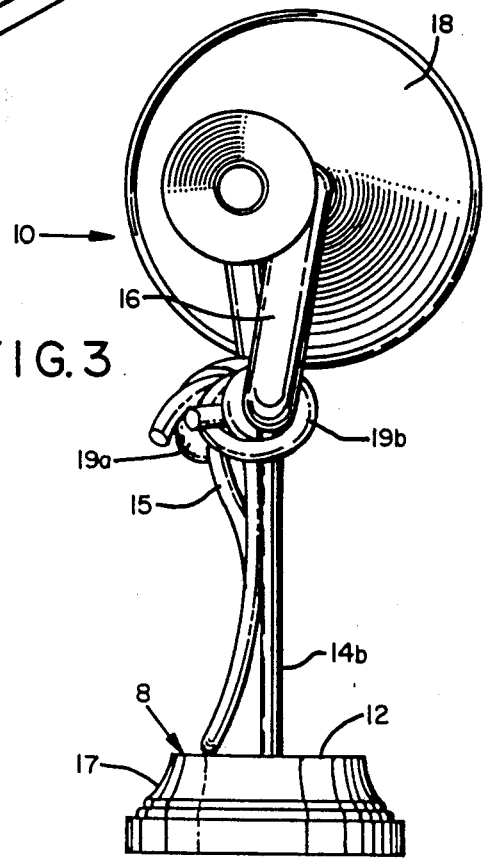
FIG. 3

BUGLE ALARM CLOCK SYSTEM

BACKGROUND OF THE INVENTION

The present invention relates to the field of alarm clocks, and particularly to an alarm clock system having an appearance and corresponding predetermined cooperative music generating capability which together provide a system for awakening a user.

A wide variety of alarm clocks are known in the prior art. They include mechanical, electromechanical and solid state electronic devices. The prior art alarm clocks provide for various predetermined audible signals for signaling or awakening a user at a predetermined time. Such signals include bells, buzzers, electronic beeps and other sounds. For example, U.S. Pat. No. 390,786 to Lane shows a mechanical apparatus for striking a bell, the apparatus being actuated by a clock at a predetermined time. Additionally, there are alarm clocks which provide visual signals, such as flashing lights, and those which emit a combination of light and sound.

One popular alternative to an alarm clock which emits a predetermined signal is a clock radio. A clock radio is a combination of a clock and a radio interconnected so that the radio is switched on at a predetermined time according to the clock. Such devices awaken the user to music or other radio programming. Timers also are available which may be used to switch on a television set or other audio-visual or audio device at a preset time. These devices suffer the shortcoming that the particular song or other programming to which the user wakens cannot be predicted.

A predetermined program or musical tune may be provided by integrating a clock apparatus with an apparatus for playing the desired tune. For example, a cassette tape player is shown integrated with an alarm clock in U.S. Pat. No. 3,376,700 to Davis et al. A similar function might be achieved by connecting a suitable timer to activate a phonograph record player. Phonographs and cassette players with timers are too cumbersome and expensive for normal bedside alarm usage.

What is needed is an alarm clock system which notifies or awakens the user by generating a predetermined audible sound and has an appearance which cooperates with the audible sound.

SUMMARY OF THE INVENTION

Many persons in the United States, particularly persons having experience in the military, are familiar with the classic bugle call "Reveille." The tune has been played for many decades for the purpose of awakening persons within hearing distance. The present invention includes an alarm clock system which provides a combination of sight and sound emulating the famous military tradition of awakening persons by playing Reveille on a bugle. It is an object of the present invention to provide an alarm clock system which provides an audible rendition of Reveille to notify a user and in which the appearance of the alarm clock system cooperates with the audible rendition of Reveille.

An alarm clock system is provided, comprising a replica of a bugle, preferably made of brass, mounted on a stand in a playing position. The bugle replica includes music player means for generating a predetermined audible signal, preferably a rendition of the tune Reveille; clock means for keeping time; means for setting an alarm time; and means for transmitting an actuating signal to the music player at the alarm time, thereby activating the music player to play Reveille. Optionally, provision is made for actuating the music player means by manual input at any time. The music player means and the clock means are mounted in the flare of the bugle replica so that the clock is easy to read, and so that the music player means cooperates with the appearance of the system to provide a system for awakening a user which emulates the playing of a military field bugle.

The music player means is preferably implemented in a single integrated circuit. It comprises music memory means containing a digital representation of the tune Reveille; means connected to said music memory means for converting the digital representation of the frequency of each musical note to an analog signal; means, connected to receive said analog signals, for converting each of them to an audio frequency signal. A power amplifier amplifies the resulting audio signals and drives a speaker.

The music memory means can include notes of the tune Reveille stored in a one-of-64 representation, and a look-up table memory, containing the natural logarithms of the actual desired frequencies. The preferred embodiment includes an oscillator means having a logarithmic transfer function, $V_{out}=e^{V}in$.

The appropriate duration of each note may be achieved by storing in the music memory means a sequence of notes, each having a fixed duration, which in the aggregate equal the desired duration of each note of Reveille. Alternatively, a digital representation of the corresponding desired duration may be provided for each note in the music memory. In the latter case, control circuitry applies the digital duration information in controlling the music player circuitry to reproduce the note for the correct duration.

The foregoing and other objects, features and advantages of the invention will become more readily apparent from the following detailed description of a preferred embodiment which proceeds with reference to the drawings.

BRIEF DESCRIPTION OF THE DRAWINGS

FIG. 1 is a perspective view of a bugle alarm clock system according to the present invention.

FIG. 2 is a front elevation of the bugle alarm clock system of FIG. 1.

FIG. 3 is a rear elevation of the bugle alarm clock system of FIG. 1.

DETAILED DESCRIPTION OF A PREFERRED EMBODIMENT

Figure 4:
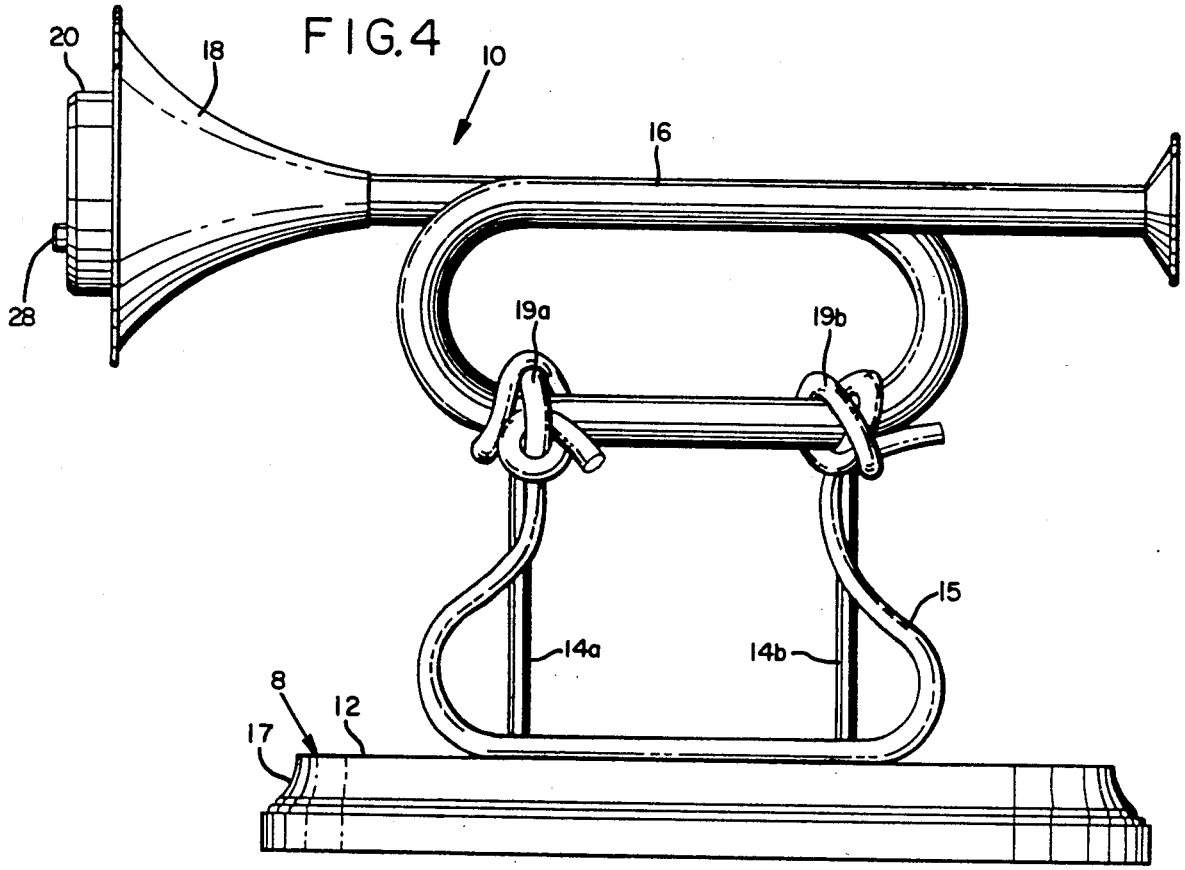
FIG. 4 is a side elevation of the bugle alarm clock system of FIG. 1.

Referring to FIGS. 1–4, a bugle alarm clock system 10 comprises a stand 8, a bugle replica 16 mounted on the stand, and a clock case 20, mounted within the flare end of the bugle replica. The clock case contains a clock and a music player. The bugle and stand position the clock case and the user controls are arranged on the front on the clock case so that the clock may be read and or operated by a user, and so that the bugle call Reveille is emitted from the flare of the bugle replica so as to emulate a genuine bugle.

The stand 8 consists of a support base 12 and support posts 14*a* and 14*b*. The stand is arranged to support a bugle replica 16 in a substantially horizontal orientation, as it would be played. The support base 12 has a smooth, planar underside for resting on a table top such as a bedside table in the home. Optionally, it may have ornamentation such as beveled edges 17. The support base is made of any suitable rigid material, such as wood or plastic. It must be sized and weighted relative to the bugle replica to support the bugle and so that the entire combination is stable and resists toppling over.

Two upright support posts 14*a* and 14*b* each are fixed into the top of the support base and spaced apart a distance so that they will effectively support a bugle replica described below. The support posts may be made of any suitable rigid material, such as wood, metal or plastic.

A bugle replica 16, including a flare portion 18, is fixed to the top ends of the posts 14*a* and 14*b* in a horizontal position like a bugle conventionally is held when in use. The bugle replica preferably is made of a metal such as brass so that it faithfully emulates the appearance of a military field bugle. The replica need not function like a genuine bugle, however, as the required sound is produced electronically as described below. The bugle replica is preferably smaller than a genuine bugle for greater convenience.

A cord 15 is tied to the bugle at its ends 19*a* and 19*b* so as to emulate a lanyard used on a genuine field bugle. A central portion of the cord is adhered to the support base with any suitable adhesive, such as epoxy. The knots may be treated with a suitable adhesive to fix them in place. The cord may be of any suitably sized flexible material, preferably woven cotton or synthetic rope.

Referring now to FIGS. 1 and 2, a cylindrical clock case 20, having a numeric material display window 21, is mounted in the flare of the bugle replica. The clock case is removable for changing a battery (not shown). The stand and the bugle replica hold and position the clock case so that the clock display window is visible to a user. The clock case contains a miniature battery-operated digital clock apparatus that provides for setting an alarm time and generates an actuating signal at the alarm time for actuating a music player. These functions and the music player are more fully described below. The music player is mounted in the bugle replica, preferably within the clock case 20.

The display window 21 provides a numeric display for displaying the time of day and for setting an alarm time. A digital numeric display 32 (shown only as a functional element in FIG. 5), preferably has six digits for displaying hours, minutes and seconds. The display 32 is mounted behind the display window 20 so that it can be seen by a user viewing the alarm clock system from the flare end of the bugle. The clock case has a MODE button 26 and a SET button 28 mounted on its face so that said buttons are readily operable by the user. These buttons are used to set the time of day and an alarm time as described below in the Operation section. The clock face also has at least one aperture 23 for allowing sound from a speaker 44 (see FIG. 5) to be heard. The speaker 44 is mounted behind the clock face substantially aligned with the apertures.

Description of the Clock and Music Player

Figure 5:
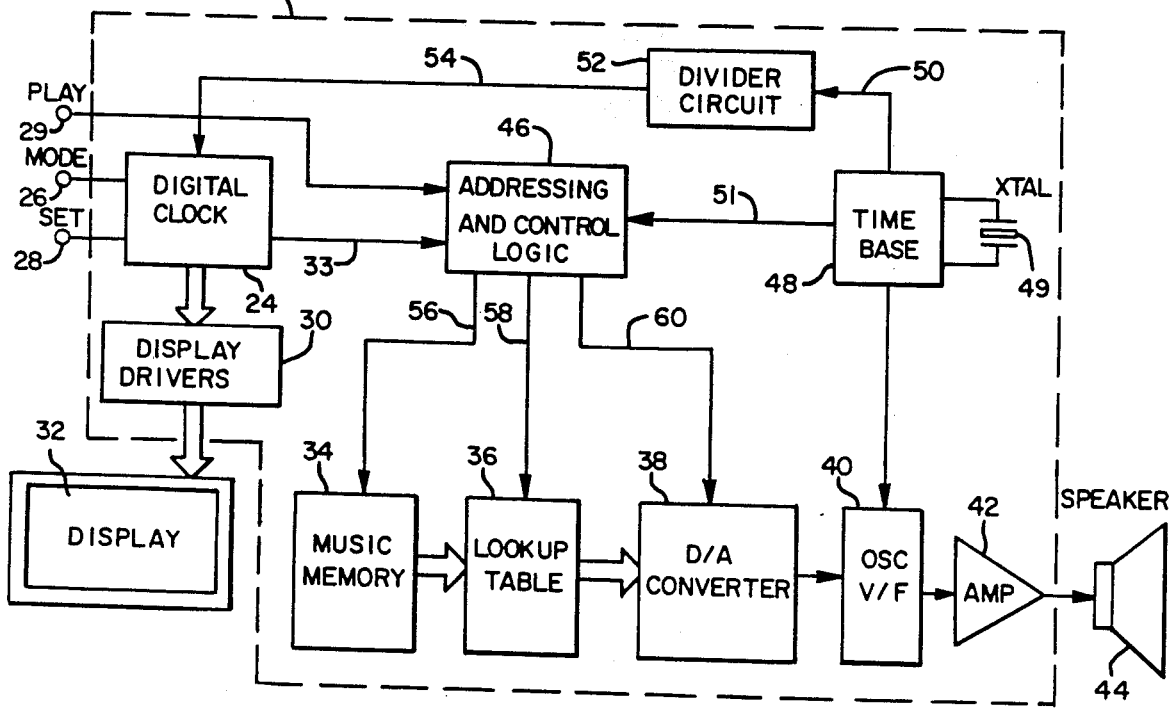
FIG. 5 is a functional block diagram of the electronics contained in the bugle alarm clock system of FIG. 1.

The functional elements of the clock and music player apparatus are shown in the block diagram of FIG. 5. The blocks shown in FIG. 5 represent circuits which are commercially available and, therefore, their details are not set forth here. The electronics are described functionally as follows.

The electronic circuitry is formed on a single printed circuit board 22 identified by a dashed line or implemented in a single integrated circuit. The display 32, which may be, for example, a liquid crystal display, and the audio speaker 44 are mounted off the printed circuit board 22 or outside a corresponding integrated circuit. Additionally, in an integrated circuit implementation, the crystal 49 is likely to be a discrete component. The battery (not shown) may be mounted on a printed circuit board, or apart from it, but in any event, is outside of the integrated circuit. Preferably, the battery is a small wristwatch or hearing aid type.

Apart from the above-described discrete components, the electronics consists of two functional sections, the clock section and the music player. The clock section appears generally at the left portion of FIG. 5. It includes a digital clock 24, display drivers 30 and display 32. These components are conventional, and are commonly found implemented in a single integrated circuit.

The digital clock 24 may have an internal time base or receive a timing signal 54 from timing circuitry described below. The clock 24 provides an actuating signal, line 33, to trigger the music player at a predetermined "alarm time" set by the user. The alarm time, as well as the time of day, are set by the user by use of conventional MODE button 26 and SET button 28.

The music player, shown in the right portion of FIG. 5, includes a music memory 34, containing a representation of the melody "Reveille." The music is shown in V. F. Safranek (Band Leader, U.S. Army, Retired), "Complete Instructive Manual for Field Trumpet and Drum," (Carl Fisher, Inc., New York City 1916). The music player further includes a look-up table memory 36, a digital-to-analog converter 38, a voltage controlled oscillator 40, and an audio amplifier 42. Power and ground connections are not shown as they are conventional and well-known.

The music player also includes addressing and control circuitry 46 and timing circuitry. The timing circuitry includes a time base 48 which utilizes a crystal 49 to provide a stable and accurate timing signal. The timing signal is provided over path 50 to a frequency divider 52 which provides a lower frequency timing signal 54 to the digital clock 24. There is also provided, optionally, a play button 29 which activates the music player independent of the clock section via a signal to logic 46.

The user selects and sets an alarm time, i.e., a time when he or she wishes to be notified or awakened, as described below in the Operation section. When the alarm time is reached, clock 24 asserts an actuating signal on line 33 which notifies the control logic 46 that it is the alarm time. Alternatively, the music player is activated directly by manual actuation of the play button 29.

In response to either the actuation signal or the play button input, the control logic begins playing Reveille in the following manner. The control logic resets an address counter (not shown), presents the initial address to the music memory 34, and "reads" information representing the first musical note of Reveille from music memory 34. The data thus read is presented to look-up table 36. Look-up table 36 is a memory containing frequency information to convert the representation in memory 34 to the correct actual frequencies required to produce the music. Thus, the correct frequency of the first note is read from the look-up table and then provided to a digital-to-analog converter (D/A) 38. The D/A converts that frequency information to a voltage representative of the selected frequency.

The voltage representing the frequency of the first note is provided to a voltage-controlled oscillator 40. The oscillator converts the voltage into a corresponding audio frequency. The resulting audio frequency signal is provided to an audio amplifier 42 which in turn drives the speaker 44. These steps are accomplished in proper sequence by virtue of control lines 56, 58 and 60, whereby the control logic 46 coordinates these activities.

The control logic 46 also controls the duration of the musical note, as more fully described below. At the conclusion of the appropriate time, the next note of the sequence which makes up the tune "Reveille" is read from the music memory 34 and the sequence just described is repeated, and so on, until the rendition of Reveille is completed.

Internal Representation of the Music and Conversion to Audio

The method of storing and converting the information necessary to reproduce the required melody is as follows. The music memory 34 is a ROM or read-only memory, the details of which are well-known in the solid state digital memory field. The music memory contains approximately 1,000 or 1K words of 8 bits each. Each word of the memory represents a note from the melody known as "Reveille," represented as one of 64 notes.

The 6-bit quantity representing a note is read from the music memory 34 and presented as an address to look-up table memory 36. This memory has the actual desired frequencies stored at addresses corresponding to the one-of-64 representation used in the music memory. Thus, the look-up table requires only 64 words, each of them being 15 bits wide, in order to cover essentially the entire audio spectrum, rounding each frequency to the nearest whole number (Hertz).

This method of representation covers a range of any chosen 6 octaves, for example from Middle C (261.63 Hz) to C10 (16,744 Hz), using only 6 bits of memory per note. This method of storing a musical note, using a one-of-64 representation, is superior to simply storing the actual frequency of each note, because the frequency range spanned, over 16 KHz, would require 14 bits of resolution per note.

The savings of memory space may be appreciated by way of the following illustrative calculation. Storage of a tune consisting of, for example, 2,000 notes requires a first memory of 8 bits by 2,000 or 16K, plus a look-up table of 6 bits by 15 bits or about 0.1K, a very small table. By comparison, direct storage of the actual frequencies would require a memory of 15 bits by 2,000 or about 30K, nearly twice the memory of the method described above. Nonetheless, the memory savings is small where the musical selection is short and simple, and implementation of the single-memory method is simpler and may be advantageous.

The duration of each musical note is provided for in either of two ways. First, a standard unit of time may be selected, such as 100 msec, roughly corresponding to a sixteenth note in music. The timing information is generated by the time base 48 and provided to the control logic via path 51. Every note stored in the music memory is "played" for that duration. Each note which requires longer duration, such as a quarter note, is repeated in the memory the appropriate number of times (four in the case of a quarter note), so that it is "played" repeatedly, resulting in the correct duration. Well-known filtering methods may be used to smooth the sequence of notes. This method requires more memory than the alternative described below but is simple to implement. In this method, the remaining 2 bits of the 8-bit wide music memory are not required.

Alternatively, a representation of the duration of each note may be stored in the music memory in the 2 bits adjacent the 6-bit representation of the note's frequency. These 2 bits allow a one-of-four selection of duration. The basic unit could correspond to a sixteenth note, for example, in which case the longest note stored in a single word of the music memory would be four-sixteenths or a quarter note. Longer notes, such as a whole note (having duration of sixteen sixteenths, as is well-known in music), would be stored as a sequence of four quarter notes, thus requiring four words in memory. In this approach, the 2-bit duration information is used to control the timing in the addressing and control circuitry 46. In the fixed-duration approach described above, the control and addressing simply run at a fixed pace, reading the next address from memory at each "beat" of the clock circuitry.

One difficulty likely to be encountered in implementing the circuitry described above is in building a digital-to-analog converter which can accurately resolve inputs over such a broad range, i.e., 20 to 20,000. This broad range reflects the logarithmic relationship of musical notes. One octave in music is a doubling of frequency. This relationship leads to the need to cover a range of about 20 Hz to 20,000 Hz, or three decades of frequency, whereas the number of different musical notes over the audio spectrum is merely on the order of 100.

Further, resolution of 10 or 20 Hertz is important among the lower notes, as this may represent a variation of 50 or even 100 percent, but unimportant among the higher notes, for example C7 (2,093 Hz), where 20 Hertz is less than 1 percent. The necessary resolution may be achieved, and memory space saved, by storing in the look-up table memory the natural logarithm of the desired frequency. The natural logs of the required frequencies range from about 2.3 ($\log_e 10$) to 9.8 ($\log_e 18{,}000$). This covers the necessary frequency range with a range of numbers conveniently represented by circuit voltages.

Further, using logarithmic representations, the look-up table memory need be only 10 or 12 bits wide to represent each musical note with sufficient resolution.

Using this approach, the voltage controlled oscillator 40 is logarithmic, having a transfer function: Frequency out$=e^{V\text{-}in}$ Hz. Circuitry to implement this function is straightforward, owing to the natural logarithmic relationships inherent in electronic circuit components. Such circuitry is well known and is shown, for example, in James K. Roberge, Operational Amplifiers, pp 496–502 (John Wiley & Sons, Inc. New York 1975).

Operation of the Alarm Clock System

The user first installs the appropriate battery to power the alarm clock system, if it is not already installed. Next, the user sets the correct time of day depressing the MODE button and the SET button on the front of the clock case. The system then functions like a clock. To utilize the signalling capability, the user sets an alarm time, again by using the MODE and SET buttons, and again uses them to enable the alarm function. Subsequently, at the alarm time, the system plays Reveille, thereby signalling the user that it then is the alarm time.

Having illustrated and described the principles of our invention in a preferred embodiment thereof, it should be readily apparent to those skilled in the art that the invention can be modified in arrangement and detail without departing from such principles. We claim all modifications coming within the spirit and scope of the accompanying claims.

We claim:

1. An alarm clock system, comprising:

a replica of a bugle;

means disposed within the bugle replica for generating an audible rendition of the tune Reveille;

clock means disposed within the bugle replica for keeping time;

means disposed within said clock means for setting an alarm time;

means for transmitting an actuating signal to said Reveille generating means responsive to the clock means indicating the alarm time; and means responsive to the actuating signal for actuating the Reveille generating means thereby commencing an audible rendition of the tune Reveille.

2. The alarm clock system of claim 1, further comprising means for manually generating the actuating signal.

3. The alarm clock system of claim 1, wherein the clock means comprises digital clock means and digital display means, the digital display means being mounted in the flare of the bugle replica so it is readable by a user.

4. The alarm clock system of claim 1, wherein the Reveille generating means includes memory means for storing a digital representation of the tune Reveille and means for receiving the digital representation of Reveille and converting it into audible sound.

5. The alarm clock system of claim 1, further comprising stand means for supporting the bugle replica in a substantially upright position.

6. The alarm clock system of claim 5, wherein the stand means comprises a support base and at least one support post connected at one end to the base and at the other end to the bugle replica.

7. The alarm clock system of claim 1, wherein the bugle replica is made of brass.

8. An alarm clock system, comprising:

a support base;

a replica of a bugle;

at least one support post, connected at one end to the support base and at the other end to the bugle replica for maintaining said bugle replica in a substantially upright position;

a clock, including means for setting an alarm time, mounted in the flare of the bugle replica so that the clock is readable by a user; and a music player, mounted within the bugle replica, for generating sound consisting of the bugle call Reveille, the music player including means for actuating said bugle call upon the clock indicating the alarm time.

9. The alarm clock system of claim 8, wherein the music player comprises:

a digital memory containing a representation of the tune Reveille;

means connected to said digital memory means for converting digital signals to analog signals;

means connected to receive said analog signals for converting analog signals to audio frequency signals; and speaker means, connected to receive said audio frequency signals, for generating audible sound corresponding to said audio frequency signals.

10. The alarm clock system of claim 8, wherein the music player comprises:

a music memory for storing a digital representation of the musical notes comprising the bugle call Reveille;

a look-up table memory, connected to the music memory, containing information for converting the representation stored in the music memory into digital frequency data;

a digital-to-analog converter, connected to the look-up table memory, for converting said digital frequency data into an analog signal representative of said digital frequency data;

control means, connected to the music memory and the look-up table memory and the digital-to-analog converter for controlling and coordinating the functions of each of them;

an oscillator, connected to said analog signal, for generating audio frequency signals in accordance with said analog signal;

an audio amplifier for amplifying said audio frequency signals to a power level adequate for driving a speaker; and a speaker, connected to receive said amplified audio frequency signals, for generating corresponding audible sound.

11. The alarm clock system of claim 8, further comprising manual input means for actuating said music player so that the bugle call Reveille may be sounded at any time; wherein the music player is responsive to said manual input means.

12. The alarm clock system of claim 11, wherein the music player comprises:

a digital memory containing a representation of the tune Reveille;

means connected to said digital memory means for converting digital signals to analog signals;

means connected to receive said analog signals for converting analog signals to audio frequency signals; and speaker means, connected to receive said audio frequency signals, for generating audible sound corresponding to said audio frequency signals.

13. The alarm clock system according to claim 11, wherein the music player comprises:

a music memory for storing a digital representation of the musical notes comprising the bugle call Reveille;

a look-up table memory, connected to the music memory, containing information for converting the representation stored in the music memory into digital frequency data;

a digital-to-analog converter, connected to the look-up table memory, for converting said digital frequency data into an analog signal representative of said digital frequency data;

control means, connected to the music memory and the look-up table memory and the digital-to-analog converter for controlling and coordinating the functions of each of them;

an oscillator responsive to said analog signal for generating audio frequency signals in accordance with said analog signal;

an audio amplifier for amplifying said audio frequency signals to a power level adequate for driving a speaker; and a speaker, connected to receive said audio frequency signals, for generating audible sound corresponding to said audio frequency signals.

14. A method of awakening a user comprising:

providing a replica of a bugle having a clock, the clock having means for setting an alarm time and having means for generating an audible rendition of the tune Reveille responsive to an actuating signal;

setting an alarm time in the clock;

transmitting an actuating signal to the Reveille generating means when the clock indicates the alarm time; and responding to the actuating signal by generating an audible rendition of the tune Reveille.

15. The method of claim 14 further comprising providing a stand for the bugle replica and mounting the bugle replica onto the stand.

16. The method of claim 14, wherein generating an audible rendition of Reveille comprises:

(a) providing a music memory containing, sequentially, a digital representation of the frequency and duration of each note of the tune Reveille;

(b) reading the digital representation of a note of Reveille from the music memory;

(c) converting said digital representation of a note into an analog signal;

(d) controlling the output frequency of an oscillator with the analog signal to produce an audio signal having the frequency indicated in the music memory;

(e) amplifying the audio signal to produce a speaker signal for driving a speaker;

(f) driving a speaker with the speaker signal to produce an audible rendition of the note for a period of time equal to the duration of the note indicated in the music memory; and (g) repeating steps b through f, inclusive, for each subsequent note of the tune Reveille, sequentially, until the audible rendition of Reveille is completed.

17. The method of claim 16, further comprising providing a look-up table memory containing digital representations of corresponding audio frequencies at respective addresses; and wherein said converting comprises:

receiving the digital representation in the look-up table memory as an address;

reading from the look-up table memory the digital representation of the corresponding audio frequency; and converting the digital representation of the corresponding audio frequency into an analog signal directly proportional to said corresponding audio frequency.

18. The method of claim 16, further comprising:

providing a look-up table memory containing digital representations of the natural logarithms of corresponding audio frequencies at respective addresses;

wherein said oscillator produces an audio frequency exponentially related to the analog signal presented to it; and said converting comprises:

receiving the digital representation in the look-up table memory as an address;

reading from the look-up table memory the digital representation of the natural logarithm of the corresponding audio frequency; and converting the digital representation of the natural logarithm of the corresponding audio frequency into an analog signal directly proportional to the natural logarithm of the corresponding audio frequency.

* * * * *